United States Patent [19]

Kato et al.

[11] Patent Number: 4,579,803

[45] Date of Patent: Apr. 1, 1986

[54] LIQUID DEVELOPER FOR ELECTROSTATIC PHOTOGRAPHY

[75] Inventors: Eiichi Kato; Kazuo Ishii; Hiroshi Ishibashi; Hidefumi Sera, all of Kanagawa, Japan

[73] Assignee: Fuji Photo Film Co., Ltd., Kanagawa, Japan

[21] Appl. No.: 703,584

[22] Filed: Feb. 20, 1985

[30] Foreign Application Priority Data

Feb. 20, 1984 [JP] Japan ..... 59-29938
Feb. 21, 1984 [JP] Japan ..... 59-30917
Feb. 28, 1984 [JP] Japan ..... 59-36787

[51] Int. Cl.[4] ..... G03G 9/12
[52] U.S. Cl. ..... 430/114; 430/119
[58] Field of Search ..... 430/114, 119

[56] References Cited

U.S. PATENT DOCUMENTS 4,062,789 12/1977 Tomai et al. ..... 430/114

*Primary Examiner*—John D. Welsh
*Attorney, Agent, or Firm*—Sughrue, Mion, Zinn, Macpeak, and Seas

[57] ABSTRACT

A liquid developer for electrostatic photography is described, containing, (i) a toner containing a resin as a main component and (ii) a copolymer comprising two repeating units represented by formula (Ia) or (Ib) and formula (II):

(Ia)

-continued (Ib)

(II)

or a copolymer comprising three repeating units represented by formula (IIIa) or (IIIb), formula (VI) and formula (V):

(IIIa)

(IIIb)

(IV)

(V)

14 Claims, No Drawings

LIQUID DEVELOPER FOR ELECTROSTATIC PHOTOGRAPHY

FIELD OF THE INVENTION

The present invention relates to a developer for electrostatic latent images, and more particularly to an improved liquid developer for converting an electrostatic latent image into a visible image in an electrophotographic process or in an electrostatographic process. This improved developer is particularly well suited for development of an electrostatic latent image on an insulating surface by positively charged toner particles.

BACKGROUND OF THE INVENTION

In a typical electrophotographic process, the surface of a recording material, which comprises a relatively highly conductive support having provided thereon a photoreceptive layer formed of photoconductive zinc oxide, is uniformly negatively charged in the dark, and then an optical image of irradiance corresponding to an input object is projected on the charged photoreceptive layer. Projecting the optical image onto the charged surface causes partial discharge depending on the irradiance on the uniformly charged surface, to create an electrostatic latent image.

The latent image can be converted to a visible image by electricity detecting toner particles made acting thereon. The visible image is directly fixed on the photoconductive surface in the so-called electrofax method. On the other hand, the electrostatic latent image or the visible image can be transferred onto a desired support through charge transfer, pressure transfer, magnetic transfer, or some other transfer step, and fixed thereto.

It is required of a general copying system to produce positive copies from an original positive. Therefore, when the surface of a photoreceptive layer is used in a negatively charged condition, it is required that the electricity detecting toner particles have strong and stable positive charges. As for the liquid developer containing positively charged toner particles, various kinds have already been available in the commercial market.

However, such commercially available developers are all designed for copying line originals or halftone originals, and unsuitable for reproduction of continuous tone images. That is to say, when continuous tone images are copied using such developers, it turns out that desired image density is not achieved, and that images formed tend to have a flow defect (so-called streaking), and furthermore, deposition of toner on non-image areas (fog) tends to occur.

Developers capable of solving the above-described problems to certain extents, and providing continuous tone images of good quality are disclosed in Japanese Patent Publication No. 26594/74 (U.S. Pat. No. 4,062,789) and so on, in which semialkylamide compounds of diisobutylene-maleic acid copolymers are used as charge controlling agents.

According to our experimental results, however, such developers were found to suffer from the disadvantage that when the developer was placed in a developing apparatus and used in development procedures repeated a great number of times, e.g., not less than 1,000 times, although the toner particles in the developer did not reverse their polarity since they possessed a strongly held positive charge, the clearness of the copy images gradually decreased. The decrease in clearness of the copies obtained resulted from a decrease in the quantity of toner particles adhering to the image area. A problem with respect to adhesion strength of the images after fixation becomes insufficient also results therefrom. Therefore, when images are formed on zinc oxide-resin coated paper using the foregoing developers and the paper is employed as an offset printing plate, the problems that hydrophobic property to printing ink and printing life are both insufficient are posed. In addition, the quality of the images reproduced through a transfer step is deteriorated to a great extent.

SUMMARY OF THE INVENTION

A primary object of the present invention is to bring about improvements upon conventional liquid developers to remedy their defects as described above.

Another object of the present invention is to provide an excellent liquid developer which can produce continuous tone images of excellent quality, and that does not cause any deteriorations in image quality, such as lowering of image density, lack of fine lines, increase in fog density, and so on, even after continuous use over a lengthy period of time.

A further object of the present invention is to provide a liquid developer which enables continuous production of a great number of offset printing plates having high hydrophobic property to printing ink and excellent printing life using an electrophotographic process.

A still further object of the present invention is to provide a liquid developer well suited for various kinds of electrostatic photographic processes and various kinds of transfer processes like a charge transfer process and so on in addition to the above-described use.

It has now been found that the above-described objects are attained by a liquid developer (1) or (2) for electrostatic photography.

The liquid developer (1) contains, in a nonaqueous solvent having electric resistance of $10^9$ Ω·cm or above and dielectric constant of 3.5 or below, at least toner containing a resin as a main component and at least one or more of a copolymer comprising two repeating units represented by the following general formulae (Ia) or (Ib) and (II):

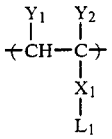

(Ia)

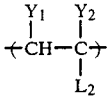

(Ib)

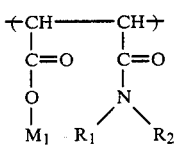

(II)

wherein $X_1$ is a group for connecting an atomic group $L_1$ to the main chain, and represents —O—, —$CH_2OCO$—, —OCO— or —COO—; $L_1$ represents an aliphatic group, an alicyclic hydrocarbon group, an aryl group or a heterocyclic group; $L_2$ represents an aliphatic group, an alicyclic hydrocarbon group, an aryl group, or a heterocyclic group each of which contains 6 or more carbon atoms in total; $Y_1$ and $Y_2$ (which can be the same or different) each represents a hydrogen atom or an alkyl group; $R_1$ and $R_2$ (which can be the same or different) each represents a hydrogen atom, an aliphatic group, an alicyclic hydrocarbon group, an aryl group, or a heterocyclic group, or $R_1$ and $R_2$ combine with each other through carbon atoms (and optionally, hetero atoms) to form a closed ring; and $M_1$ represents a hydrogen atom, a metal atom, or an ammonium or quaternary salt of an organic base.

The liquid developer (2) contains, in a nonaqueous solvent having electric resistance of $10^9$ Ω·cm or above and dielectric constant of 3.5 or below, at least toner containing a resin as a main component and at least one or more of a copolymer comprising three repeating units represented by the following general formulae (IIIa) or (IIIb), (IV), and (V):

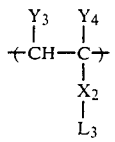

(IIIa)

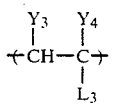

(IIIb)

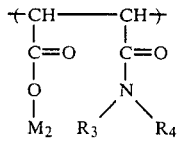

(IV)

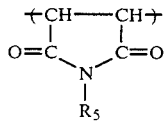

(V)

wherein $L_3$ represents an aliphatic group, an alicyclic hydrocarbon group, an aryl group, or a heterocyclic group; $Y_3$, $Y_4$, $X_2$, $M_2$, $R_3$ and $R_4$ each has the same meaning as $Y_1$, $Y_2$, $X_1$, $M_1$, $R_1$ and $R_2$, respectively; and $R_5$ represents a hydrogen atom, an aliphatic group, an alicyclic hydrocarbon group, an aryl group, or a heterocyclic group.

DETAILED DESCRIPTION OF THE INVENTION

In the copolymer used in the liquid developer (1), $L_1$ preferably represents an unsubstituted or substituted alkyl group having from 1 to 32 carbon atoms (e.g., methyl, ethyl, propyl, butyl, pentyl, hexyl, heptyl, octyl, decyl, undecyl, dodecyl, tetradecyl, hexadecyl, heptadecyl, octadecyl, chloromethyl, 3-chloropropyl, 2-cyanoethyl, 3-hydroxypropyl, N,N-dimethylaminoethyl, etc.), an unsubstituted or substituted alkenyl group having from 4 to 32 carbon atoms (e.g., 2-pentenyl, 4-propyl-2-pentenyl, isobutylenyl, oleyl, linoleyl, etc.), an unsubstituted or substituted aralkyl group having from 7 to 32 carbon atoms (e.g., benzyl, phenethyl, etc.), an unsubstituted or substituted cycloalkyl group having from 5 to 32 carbon atoms (e.g., cyclopentyl, cyclohexyl, etc.), an unsubstituted or substituted aryl group having from 6 to 32 carbon atoms (e.g., phenyl, naphthyl, 4-chlorophenyl; 4-octylphenyl, 4-methoxyphenyl, etc.), or a not less than 5-membered unsubstituted or substituted heterocyclic ring group (e.g., furyl, pyranyl, piperazinyl, indolinyl, etc.).

$L_2$ preferably represents an unsubstituted or substituted alkyl group having from 6 to 30 carbon atoms in total (e.g., hexyl, 2-ethylhexyl, octyl, decyl, dodecyl, tetradecyl, hexadecyl, octadecyl, docosanyl, 10-methoxycarbonyloctamethylene, 10-hexyloxycarbonyloctamethylene, etc.), an unsubstituted or substituted aralkyl group having from 7 to 32 carbon atoms in total (e.g., benzyl, phenethyl, 3-phenylpropyl, 4-butylphenylmethyl, 4-methoxyphenylmethyl, 2-chlorophenylmethyl, 2-methoxyphenylethyl, 4-methoxycarbonylphenylethyl, 4-butoxycarbonylphenylmethyl, 3-(4-chlorophenyl)propyl, etc.), a cycloalkane group having 6 or more carbon atoms in total (e.g., cyclohexyl, etc.), or an unsubstituted or substituted aryl group having from 6 to 32 carbon atoms in total (e.g., phenyl, 4-chlorophenyl, 4-methylphenyl, 4-butylphenyl, 4-methoxyphenyl, 4-octylphenyl, etc.).

$Y_1$ and $Y_2$ each represents preferably a hydrogen atom or a methyl group.

In formula (II), $R_1$ and $R_2$ (which can be the same or different) each represents a hydrogen atom, an unsubstituted or substituted alkyl group having from 1 to 28 carbon atoms (e.g., methyl, ethyl, propyl, butyl, hexyl, octyl, 2-ethylhexyl, decyl, dodecyl, tetradecyl, hexadecyl, octadecyl, docosanyl, 3-methoxypropyl, 3-chloropropyl, 2-cyanoethyl, etc.), an unsubstituted or substituted aralkyl group having from 7 to 32 carbon atoms (e.g., benzyl, phenethyl, 4-chlorobenzyl, 4-butylbenzyl, 4-methoxybenzyl, etc.), an unsubstituted or substituted alkenyl group having from 2 to 32 carbon atoms (e.g., 2-pentenyl, allyl, isobutylenyl, oleyl, linoleyl, etc.), an unsubstituted or substituted alicyclic hydrocarbon group having from 5 to 32 carbon atoms (e.g., cyclopentyl, cyclohexyl, etc.), an unsubstituted or substituted aryl group having from 6 to 32 carbon atoms (e.g., phenyl, naphthyl, 2-chlorophenyl, 4-chlorophenyl, 4-methylphenyl, 4-methoxyphenyl, 4-butylphenyl, 4-octylphenyl, 4-butoxyphenyl, etc.), or an unsubstituted or substituted heterocyclic ring group having not less than 5 atoms (e.g., furyl, etc.). Further, $R_1$ and $R_2$ together can form a closed ring through carbon atoms, and the ring formed can contain hetero atoms (for instance, they can combine with each other to form a morpholyl group, a piperidyl group, etc.).

$M_1$ represents a hydrogen atom, a metal atom capable of forming a salt together with an organic carboxylic acid, with specific examples including alkali metals (such as sodium, potassium, lithium, etc.), alkaline earth metals (such as barium, calcium, aluminum, etc.), transition metals (such as copper, iron, titanium, cobalt, tin, etc.) and so on, or an ammonium salt or a quaternary salt (e.g., tetramethylammonium, dodecyltrimethylammonium, etc.) of an organic base (such as trimethylamine, dimethylamine, triethylamine, N,N-dimethylaniline, pyridine, morpholine or the like).

The weight ratio of the monomer component of formula (Ia) or (Ib) to the monomer component of formula (II) in the copolymer of the present invention generally ranges from 10/90 to 99.5/0.5, and preferably ranges from 30/70 to 70/30.

The molecular weight of the copolymer of the present invention which comprises the repeating units represented by the formulae (Ia) or (Ib) and (II) is generally from about 1,000 to 500,000, and preferably from about 5,000 to 50,000.

A semimaleinamide copolymer comprising the repeating units represented by formula (Ia) or (Ib) and the general formula (II), by which the present invention is characterized, can be prepared by reacting a maleic anhydride copolymer, which comprises the repeating units represented by the above formulae (Ia) or (Ib) and and the following formula (VI), with an amino compound.

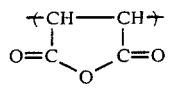

(VI)

Copolymers of maleic anhydride represented by the above-described formula (VI) can be synthesized according to conventional well-known methods. Such methods are described in detail, for instance, in Ryohei Oda ed., *Kindai Kogyo Kagaku,* Vol. 16, *Kobunshi Kogyo Kagaku,* Vol. I, p. 281, Asakura Shoten (1966); Gi-ichi Akazome, et al., *Kobunshi Kagaku,* Vol. 17, No. 186, p. 618 (1960); Hidetoshi Tsuchida, et al., *Kogyo Kagaku Zasshi,* Vol. 70, No. 4, p. 566 (1967); J. Brandrup, et al., *Polymer Handbook,* 2nd Ed. (1975); Ohtsu, et al., *Polymer Letters,* Vol. 2, p. 973 (1964); M.M. Martin, *J. Org. Chem.,* Vol. 27, p. 1201 (1962); and so on.

Suitable examples of amine compounds which can be used in the present invention include butylamine, pentylamine, hexylamine, octylamine, decylamine, dodecylamine, tetradecylamine, hexadecylamine, octadecylamine, docosanylamine, 2-ethylhexylamine, 3,3-dimethylpentylamine, allylamine, hexenylamine, dodecenylamine, tetradecenylamine, hexadecenylamine, octadecenylamine, 2-nonyl-2-butenylamine and the like.

The compounds employed according to the present invention are the reaction products of copolymers of maleic anhydride as illustrated above with various kinds of amino compounds, and can be synthesized applying reaction conditions, which have so far been employed in the reaction of ordinary low molecular weight carboxylic acid anhydrides with amino compounds, to this high molecular weight case, as described in Japan Chemical Society, Ed., *Shin-Jikken Kagaku Koza,* Vol. 14, p. 1145, Maruzen Shuppan, and so on.

More specifically, a carboxylic acid anhydride and an amino compound are mixed in an organic solvent of the kind which undergoes no reaction with both the anhydride and the amino compound and in which both of them can be dissolved in the following reaction temperature range, with suitable examples including hydrocarbons (such as decane, Isopar G, Isopar H, cyclohexane, benzene, toluene, xylene and the like), ketones (such as methyl ethyl ketone, methyl isobutyl ketone and the like), ethers (such as dioxane, THF, anisole, and the like), halogenated hydrocarbons (such as chloroform, dichloroethylene, methyl chloroform and the like), dimethylformamide, dimethyl sulfoxide and so on. These organic solvents may be used alone or as combination of two or more thereof. The reacting species in a mixed condition as described above are made to react with each other at temperatures of from 20° C. to 200° C., and preferably from 25° C. to 150° C., for from 1 to 80 hours, and preferably from 3 to 15 hours. If an organic base (e.g., triethylamine, dimethylaniline, pyridine, morpholine, etc.) or an inorganic or organic acid (e.g., sulfuric acid, methanesulfonic acid, benzenesulfonic acid, etc.) is used in a catalytic amount, by analogy with the case of low molecular weight compounds, the reaction of the present invention can also be accelerated.

Specific examples of the compounds of the present invention are illustrated below. However, the present invention is not to be construed as being limited to the following examples.

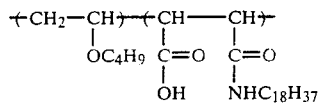

(1)

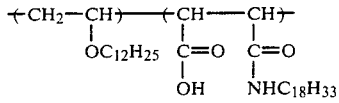

(2)

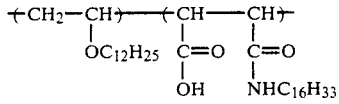

(3)

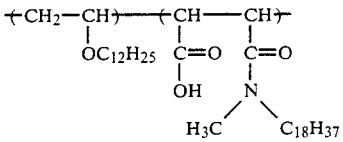

(4)

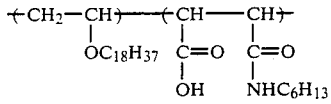

(5)

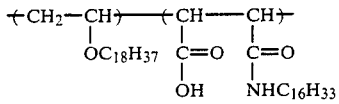

(6)

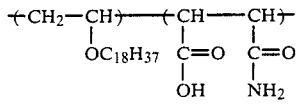

(7)

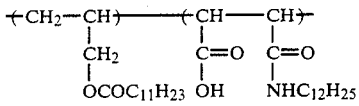

(8)

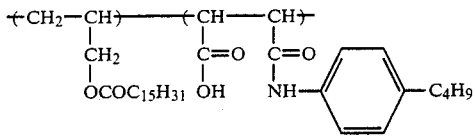

(9)

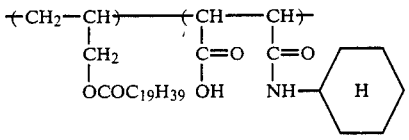

(10)

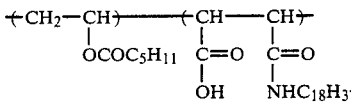

(11)

-continued
(12)
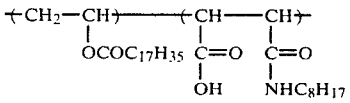
(13)
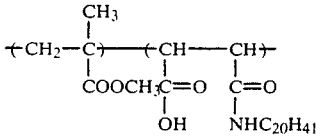
(14)
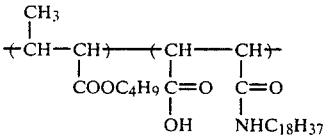
(15)
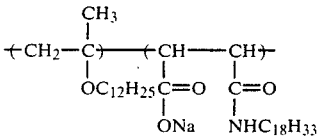
(16)
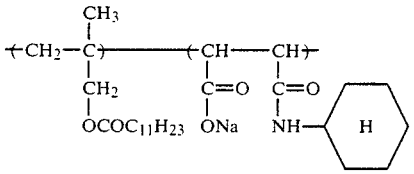
(17)
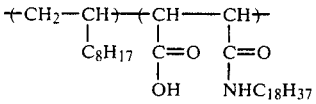
(18)
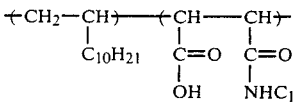
(19)
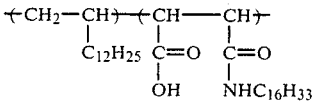
(20)
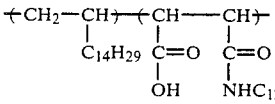
(21)
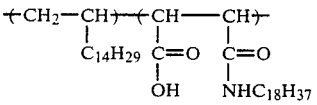
(22)
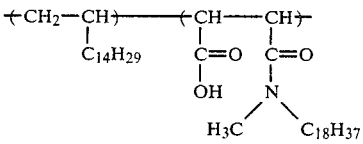
(23)
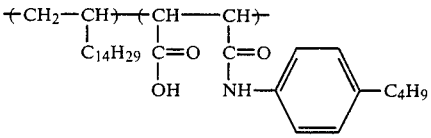
-continued
(24)
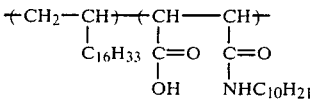
(25)
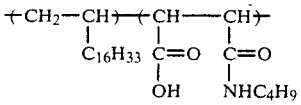
(26)
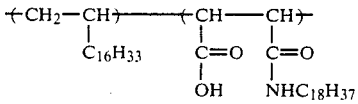
(27)
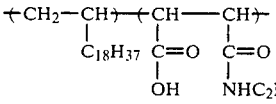
(28)
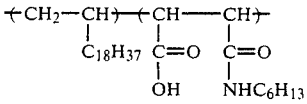
(29)
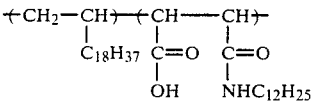
(30)
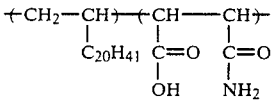
(31)
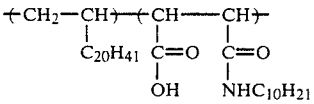
(32)
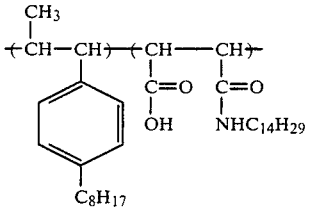
(33)
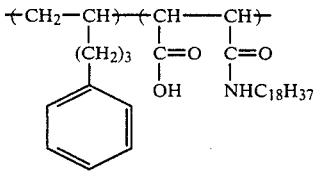
(34)
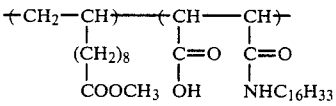

-continued (35)

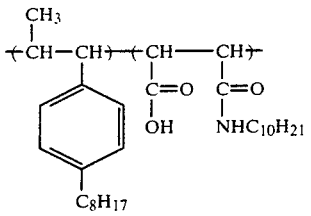

(36)

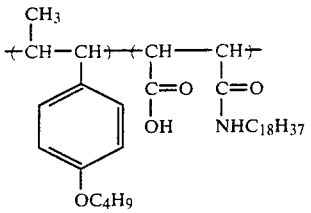

(37)

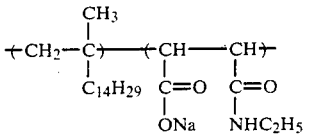

(38)

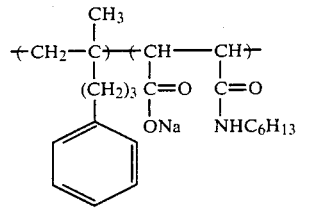

In the copolymer used in the liquid developer (2), $L_3$, $Y_3$, $Y_4$, $X_2$, $M_2$, $R_3$ and $R_4$ each preferably represents those as defined hereinbefore for $L_1$, $Y_1$, $Y_2$, $X_1$, $M_1$, $R_1$ and $R_2$, respectively. Further, $R_5$ preferably represents those as defined hereinbefore for $R_1$ and $R_2$.

Copolymer used in the liquid developer (2) is also prepared in the same general manner as the copolymer used in the liquid developer (1). That is, the copolymer can be prepared by reacting a maleic anhydride copolymer, which comprises the repeating units represented by the above general formulae (IIIa) or (IIIb) and the above general formula (VI), with certain amino compounds.

Amino compounds which can be used are primary amino compounds alone, which are represented by the following formula (VII), or both primary amino compounds represented by formula (VII) and secondary amino compounds represented by the following formula (VIII):

$$R_3NH_2 \quad \text{(VII)}$$

$$\begin{matrix} R_3 \\ \diagdown \\ \quad NH \\ \diagup \\ R_4 \end{matrix} \quad \text{(VIII)}$$

In the formulae (VII) and (VIII), $R_3$ and $R_4$ each represents an aliphatic, alicyclic, or aromatic hydrocarbon residue, or a heterocyclic ring residue, and $R_3$ and $R_4$ in formula (VIII) may be the same or different. Preferably, they each represents an unsubstituted or substituted alkyl group containing from 1 to 32 carbon atoms (e.g., methyl, ethyl, propyl, butyl, hexyl, octyl, decyl, dodecyl, tetradecyl, hexadecyl, octadecyl, docosanyl, chloroethyl, cyanoethyl, 4-butoxypropyl, 2-ethylhexyl, N,N-dibutylaminopropyl, etc.), an unsubstituted or substituted alkenyl group containing from 3 to 32 carbon atoms (e.g., allyl, 2-pentenyl, 4-propyl-2-pentenyl, decenyl, oleyl, linoleyl, etc.), an unsubstituted or substituted aralkyl group containing from 7 to 36 carbon atoms (e.g., benzyl, phenethyl, etc.), an unsubstituted or substituted alicyclic hydrocarbon residue containing from 5 to 32 carbon atoms (e.g., cyclopentyl, cyclohexyl, bicyclo[2,2,1]heptyl, cyclohexenyl, etc.), an unsubstituted or substituted aryl group containing from 6 to 38 carbon atoms (e.g., phenyl, tolyl, 4-butylphenyl, 4-decylphenyl, 4-butoxyphenyl, etc.), or an unsubstituted or substituted heterocyclic ring group containing 5 or more atoms (e.g., furyl, thienyl, etc.). In case of secondary amino compounds represented by formula (VIII), $R_3$ and $R_4$ together can form a closed carbon atom ring, and the ring formed may contain other hetero atoms (e.g., morpholyl group or so on).

Specific examples of amino compounds which can be preferably used in the present invention include ethylamine, propylamine, butylamine, pentylamine, hexylamine, octylamine, decylamine, dodecylamine, tetradecylamine, hexadecylamine, stearylamine, docosanylamine, 2-ethylhexylamine, 3,3-dimethylpentylamine, allylamine, hexenylamine, dodecenylamine, tetradecenylamine, hexadecenylamine, octadecenylamine, 2-nonyl-2-butenylamine, cyclohexylamine, benzylamine, 4-n-octylaniline, and so on.

The high molecular compounds of the present invention, which are reaction products formed with amino compounds as described above, are characterized by their components, that is, a semimaleinamide component and a maleinimide component, and can be prepared with ease by carrying out a macromolecular reaction between the maleic anhydride moieties in a high molecular compound and a primary amino compound to convert the high molecular compound into a semimaleinamide copolymer, and further conducting a dehydration ring-closure reaction therein to convert some of the semimaleinamido moieties into maleinimido moieties.

More specifically, a carboxylic acid anhydride and an amino compound are mixed in an organic solvent of a type which undergoes no reaction with either the anhydride or the amino compound, and in which both of them can be dissolved in the reaction temperature range described below. Suitable examples include hydrocarbons [such as decane, Isopar G, Isopar H (Isopar is a trademark for high-purity paraffinic compositions), cyclohexane, benzene, toluene, xylene and the like], ketones (such as methyl ethyl ketone, methyl isobutyl ketone and the like), ethers (such as dioxane, THF, anisole, and the like), halogenated hydrocarbons (such as chloroform, dichloroethylene, methylchloroform, and the like), dimethylformamide, dimethyl sulfoxide, and so on. These organic solvents may be used alone or as a combination of two or more thereof. The reacting species in a mixed condition as described above are made to react with each other under temperature of from 60° C. to 200° C., and preferably 100° C. to 180° C., for from 1 to 80 hours, and preferably for from 3 to 15 hours. If an organic base (such as triethylamine, dimethylaniline, pyridine, morpholine, etc.) or an inorganic or organic acid (such as sulfuric acid, methanesulfonic acid, benzenesulfonic acid, etc.) is used in a catalytic amount, the reaction of the present invention can be accelerated. Further, a general dehydrating agent (e.g., phosphorus pentoxide, dicyclocarboxydiimide, etc.) may be used together in said reaction.

The thus obtained reaction product is, as described above, a high molecular compound comprising a semimaleinamide component and a maleinimide component. The weight ratio of the monomer component of formula (IV) (i.e., semimaleinamide component) to the monomer component of formula (V) (i.e., maleinimide component) in the copolymer of the present invention generally ranges from 10/90 to 90/10, and preferably ranges from 30/70 to 70/30. On the other hand, the weight ratio of the monomer component of formula (IIIa) or (IIIb) to the monomer component of formula (IV) plus the monomer component of formula (V) (i.e., weight ratio of $$\frac{\text{(IIIa) or (IIIb)}}{\text{(IV) plus (V)}})$$

generally ranges from 10/90 to 99.5/0.5, and preferably ranges from 30/70 to 70/30. The molecular weight of the high molecular compound is generally within the range of 1,000 to 500,000, and preferably is from 5,000 to 50,000.

Specific examples of the copolymer used in the liquid developer (2) of the present invention are illustrated below. However, the present invention is not to be construed as being limited to the following examples.

(Ia) and —$L_2$ in the formula (Ib). That is, the group for connecting an atomic group $L_1$ to the main chain in the formula (Ia) (i.e., $X_1$) includes an ester bond or an ether bond. The substituent for the formula (Ib) (i.e., $L_2$) is a substituent having 6 or more carbon atoms. These characteristics lead to a remarkable increase in the repeated use possible for the liquid developer and excellent storability.

In the copolymers comprising the repeating units represented by the formula (Ib) and (II), more preferred results can be obtained when the total number of carbon atoms of the substituents $L_2$, $R_1$ and $R_2$ is 14 or more and further the number of carbon atoms of the substituent $L_2$ is 10 or more.

The copolymers used in the liquid developer (2) are characterized in the maleimide component of the formula (V) in addition to the semimaleinamide component of the formula (IV). These characteristics lead to a remarkable increase in the repeated use possible for the liquid developer and excellent long storability.

The above superior results would be due to that the copolymer used in the present invention has remarkably excellent adsorption efficiency with respect to the toner particles present in the liquid developer and/or that the charging characteristics of the developing agent are scarcely influenced by the copolymer of the present invention even if the copolymer is not adsorbed to the toner particle and present in the developer medium, as

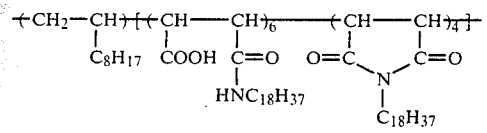
(39)

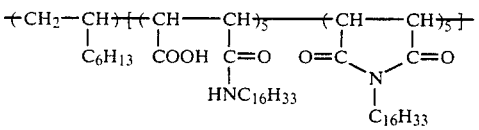
(40)

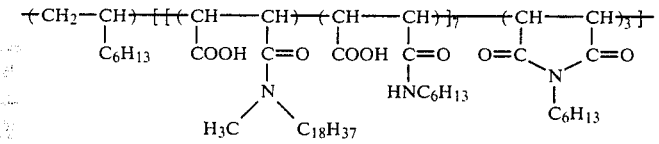
(41)

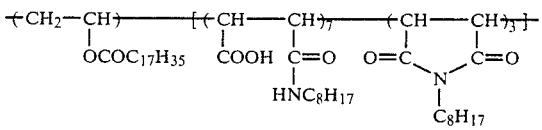
(42)

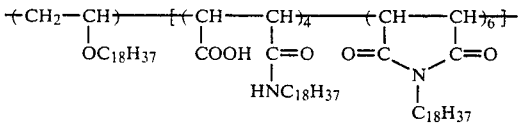
(43)

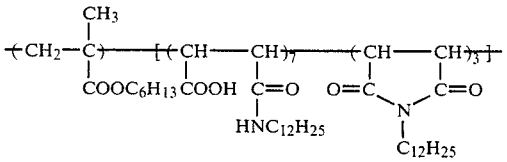
(44)

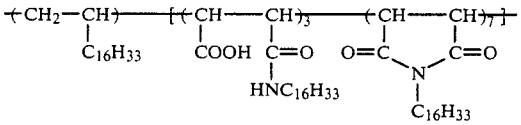
(45)

According to the present invention, it is found that not only can a remarkable increase in the number of repeated use possible for a liquid developer be achieved by addition of the polymeric compounds of the present invention, compared with semialkylamide compounds of diisobutylene-maleic acid copolymer described in U.S. Pat. No. 4,062,789, but also deterioration of properties upon long term storage can be substantially prevented.

The copolymer used in the liquid developer (1) of the present invention is different from the copolymer of U.S. Pat. No. 4,062,789 in the substituent for the units of the formula (Ia) and (Ib), i.e., —$X_1$—$L_1$ in the formula compared with the diisobutylenesemimaleinealkylamide copolymer of U.S. Pat. No. 4,062,789. That is, the copolymer of the present invention comprises (i) a semimaleinamide component which acts as a main component to keep the positive charge on the toner particles; (ii) a maleimide component which acts as a main component to keep the charged amount of the liquid developer containing positively charged toner particles and to keep the stability of the liquid developer; and/or (iii) copolymer components represented by the formulae (Ia) or (Ib) and (IIIa) or (IIIb), and thereby the liquid developer of the present invention can provide superior properties.

Suitable examples of nonaqueous solvents having an electric resistance of $10^9$ Ω·cm or more and a permittivity (dielectric constant) of 3.5 or less which can be employed include straight or branched chain aliphatic hydrocarbons, alicyclic hydrocarbons, aromatic hydrocarbons, halogenated hydrocarbons and the like. Of these solvents, octane, isooctane, decane, isodecane, nonane, dodecane, isododecane, decaline, petroleum solvents of isoparaffin series, such as Isopar E, Isopar G, Isopar H and Isopar L (trade names, produced by Exxon Chemical Japan Ltd.) Shellsol-71 (trade name, produced by Shell Oil Company), Amsco OMS (trade name, produced by American Mineral Spirits Company) and the like are used to greater advantage from the viewpoints of volatility, stability, toxicity, odor and so on. Such solvents may be used individually or as a mixture of two or more thereof.

The present invention is not particularly restricted as to toner particles, and any known toner can be employed in the present invention. More specifically, any resin may be used as a main constituent element of toner particles provided that the resin is substantially insoluble in the organic solvents set forth above. Suitable examples of resins which can be used include synthetic resins such as acryl resins, ester resins, amide resins, alkylene resins, phenol-denatured alkyd resins, epoxy resins, rosin, synthetic rubbers and so on, and natural resins. Resin dispersions which can be employed in the liquid developer of the present invention can be prepared using methods well known to those skilled in the art. For instance, one method involves dispersing a desired resin into a nonpolar solvent by means of a ball mill or a high-speed stirrer. Another method involves using monomers which are soluble in a nonpolar solvent, whereas they become insoluble in said solvent when polymerized to be converted to a resin (so-called polymer granulation). A method of this type is described in detail in, e.g., K. E. J. Barrett, *Dispersion Polymerization in Organic Media,* John Wiley and Sons, London (1974), U.S. Pat. Nos. 3,637,569 and 3,753,760, and so on.

It is desirable to control a granule size in the resin dispersion to be prepared to 5 microns or less, particularly 2 microns or less.

Coloring agents can also be used as a constituent element of the toner particles, if desired. The coloring agents have no particular restrictions in the present invention, and may include various pigments and dyes which have previously been used. Such a coloring agent may be used in a condition that it is dispersed independently in a nonpolar solvent as described above with the aid of a dispersion accelerator or the like, or in a form of grafted particles which are prepared by chemically binding polymer molecules to the surface of individual coloring agent particles (e.g., Graft Carbon, trademark for product of Mitsubishi Gas Chemical Industries Ltd.). Further, coloring agents may be incorporated in the foregoing resins.

With respect to the method for coloring the foregoing dispersed resins, a method has been described in Japanese patent application (OPI) No. 75242/73 (the term "OPI" as used herein refers to a "published unexamined Japanese patent application"), and so on, in which a coloring agent is physically dispersed into a resin by means of a dispersing device (such as a paint shaker, a colloid mill, a vibrating mill, a ball mill or so on). A great number of pigments and dyes have been known to be usable in the above-described method. Specific examples of such pigments and dyes include magnetic iron oxide powders, carbon black, Nigrosine, Alkali Blue, Hansa Yellow, Quinacridone Red, Phthalocyanine Blue, Phthalocyanine Black, Benzidine Yellow, and so on.

There has been another coloring method in which a resin dispersion is dyed with an appropriate dye through heating, as described in Japanese patent application (OPI) No. 48738/82. Specific examples of dyes which can be used in such a method include Hansa Yellow, Crystal Violet, Victoria Blue, Malachite Green, Celliton Fast Red, Disperse Yellow, Disperse Red, Disperse Blue, Solvent Red, and so on.

Still another coloring method involves a dispersed resin chemically bound to a dye. For instance, chemical binding can be achieved by reacting a resin with a dye, as described in Japanese patent application (OPI) No. 54029/78; or by, prior to polymerization, binding a dye to such a monomer as to produce insoluble resin in a dispersed condition through polymerization, as described in Japanese Patent Publication No. 22955/69, and so on.

In order to disperse the above-described resins and coloring agents into the foregoing nonaqueous solvents in a stabilized condition, conventional dispersion stabilizers can be employed. Specifically, various kinds of synthetic or natural resins can be used individually or in a combination of two or more thereof. Suitable examples of such resins include homopolymers and copolymers prepared from one or more monomers selected from a group comprising alkyl acrylates or methacrylates having an alkyl chain containing from 4 to 30 carbon atoms in total (which may be substituted with a halogen atom, a hydroxyl group, an amino group, an alkoxy group or other groups, or may contain a hetero atom, such as an oxygen atom, between carbon-carbon bonds in the main chain), vinyl esters of fatty acids, vinyl alkyl ethers, and olefins such as butadiene, isoprene, diisobutylene, etc., and copolymers of monomers as described above, which can produce polymers soluble in aliphatic hydrocarbon series solvents, and one or more monomers selected from various monomers as described below.

Suitable examples of copolymerizing monomers described above include vinyl acetate, methyl acrylate or methacrylate, ethyl acrylate or methacrylate, n-propyl acrylate or methacrylate, isopropyl acrylate or methacrylate, styrene derivatives such as styrene, vinyltoluene, α-methylstyrene, etc., unsaturated carboxylic acids such as acrylic acid, methacrylic acid, crotonic acid, maleic acid, itaconic acid, etc., or anhydrides thereof, and monomers containing a variety of polar groups (e.g., hydroxy, amino, amido, cyano, sulfonic acid, carbonyl, halogen, heterocyclic ring, etc.), such as hydroxyethylmethacrylate, hydroxyethylacrylate, diethylaminoethylmethacrylate, N-vinylpyrrolidone, acrylamide, acrylonitrile, 2-chloroethylmethacrylate, 2,2,2-trifluoroethylmethacrylate and so on. In addition to the above-described synthetic resins, other resins such as alkyd resin, alkyd resins denatured with various kinds of fatty acids, linseed oil-denatured polyurethane resin, and so on, can also be used.

Main components are contained in the following amounts in the liquid developer of the present invention.

Toner particles constituted mainly with a resin and a coloring agent are preferably contained in an amount of from 0.5 to 50 parts by weight per 1,000 parts by weight of a liquid medium. If the toner particles are contained in an amount of less than 0.5 part by weight, the density of the developed image is insufficient, whereas if more than 50 parts by weight is contained, generation of fog in non-image areas tends to occur. Resins soluble in a liquid medium, which can function as the foregoing dispersion stabilizer, can be used optionally, and a suitable addition amount thereof ranges from about 0.5 to about 100 parts by weight per 1,000 parts by weight of the liquid medium. The compound of the present invention, which functions as charge controlling agent, can produce a remarkable effect when added in a very slight amount to the liquid medium. The optimal addition amount thereof ranges from 0.001 to 0.5 part by weight per 1,000 parts by weight of the liquid developer.

If the charge controlling agent is contained in an amount below the above-described lower limit, retention of positive charge by toner particles becomes unstable, whereas if the content is increased beyond the foregoing upper limit, reduction in the electric resistance of the developer is caused and, consequently, the density of the image obtained is lowered.

Furthermore, various kinds of additives may be added to the liquid developer, if desired. Specific examples of such additives are described, for instance, in Yuji Harasaki, *Denshi Shashin,* Vol. 16, No. 2, p. 44.

The additives as described above are restricted in the upper limit of their total content in the developer depending on an acceptable electric resistance of the developer. More specifically, if the electric resistance of the liquid developer in a condition that toner particles are removed therefrom is decreased below $10^9$ Ω·cm, it becomes difficult to produce continuous tone images of good quality. Therefore, it is necessary to control an addition amount of each additive within said limitation.

The present invention is illustrated in greater detail by reference to the following examples. However, the invention is not intended to be construed as being limited to these examples.

SYNTHESIS EXAMPLE 1

Synthesis of Compound (3)

A mixture of 49 g of maleic anhydride, 117 g of dodecyl vinyl ether, and 620 g of methyl ethyl ketone was heated to 70° C. with stirring in an atmosphere of nitrogen.

Thereto, 1.5 g of 2,2'-azobis(butyronitrile) was added, and stirred for 3 hours. Thereafter, 1.5 g of 2,2'-azobis(-butyronitrile) was further added, and the temperature of the resulting mixture was raised to 80° C. The stirring was continued for an additional 4 hours as the mixture was kept at that temperature. After cooling, the reaction solution was added to 3.5 liters of acetonitrile over a 15 minute period with stirring, and the stirring was further continued for an additional 1 hour. A precipitate deposited was filtered off, and dried under reduced pressure. Thus, 132 g of a white solid was obtained.

A mixture of a 31 g portion of the white solid obtained above, 24.1 g of n-hexadecylamine, 130 g of methyl ethyl ketone and 1.0 g of pyridine was heated to 70° C., and the reaction was conducted therein for 10 hours with stirring. After cooling, the reaction mixture was added to 1.0 liter of methanol over a 15 minute period with stirring. The stirring was continued for an additional 1 hour. A precipitate deposited was filtered off, and dried under reduced pressure. Thus, 69 g of a light whitish-yellow solid was obtained.

The molecular weight of this solid determined by high speed liquid chromatography was about 15,000.

SYNTHESIS EXAMPLE 2

Synthesis of Compound (26)

A mixture of 49 g of maleic anhydride, 152 g of 1-hexadecene and 494 g of toluene was heated to 90° C. with stirring in an atmosphere of nitrogen.

Keeping the mixture at 90° C., 3.50 g of benzoyl peroxide was added thereto and stirred for 3 hours. Thereafter, 3.5 g of benzoyl peroxide was further added and stirred for an additional 4 hours.

The solids content in the thus obtained polymer solution was 24.8%.

A mixture of a 100 g portion of the polymer solution obtained above, 10.2 g of n-octadecylamine and 2 g of pyridine was stirred for 10 hours under a temperature of 70° C. After cooling, the solution was added to 1 liter of methanol over a 15 minute period with stirring, and the mixture was stirred for additional 1 hour as it was. A solid deposited was filtered off, and dried under reduced pressure. Thus, 21 g of a light whitish-yellow solid was obtained. The molecular weight of the solid determined by high speed liquid chromatography was about 7,500.

SYNTHESIS EXAMPLE 3

Synthesis of Compound (39)

A mixture of 98 g of maleic anhydride, 252 g of 1-dodecene and 816 g of toluene was heated to 85° C. with stirring in an atmosphere of nitrogen.

Keeping the mixture at that temperature, 6.0 g of benzoyl peroxide was added thereto as an initiator, and stirred for 3 hours. Thereafter, 6.0 g of benzoyl peroxide was further added and stirred for an additional 4 hours.

The solids content in the thus-obtained polymer solution was 22.5%.

A mixture of a 100 g portion of the polymer solution obtained above, 23.2 g of n-octadecylamine and 2 g of pyridine was stirred at 100° C. for 8 hours. After cooling, the reaction solution was added to 800 ml of methanol over a 15 minute period with stirring. The stirring was continued for an additional 1 hour under the same condition.

The solid precipitated was filtered off, and dried under reduced pressure. Thus, 37 g of a light whitish-yellow solid was obtained. The molecular weight of this solid determined by high speed liquid chromatography was 11,000. The weight ratio of the semimaleinamido component to the maleinimido component in the solid was determined by neutralization titration using an ethanol solution of potassium hydroxide. It was 6/4.

EXAMPLE 1

A mixed solution composed of 16 g of poly(laurylmethacrylate), 100 g of vinyl acetate and 385 g of Shellsol-71 was heated to 70° C. with stirring in an atmosphere of nitrogen. Thereto, 1.7 g of 2,2'-azobis(isobutyronitrile) was added, and the reaction was conducted therein. After the reaction was allowed to continue for 10 hours, the reaction mixture was cooled. Then, the reaction mixture was passed through 200-mesh nylon cloth.

Thus, a white resin dispersion having a mean particle size of 0.18 μm was obtained at a polymerization rate of 83%.

10 g of poly(laurylmethacrylate), 10 g of Nigrosine and 30 g of Shellsol-71 were placed in a paint shaker together with glass beads, and shaken for 2 hours to achieve dispersion. Thus, the fine dispersion of Nigrosine was obtained.

A 30 g portion of the above-described white resin dispersion, a 2.5 g portion of the above-described Nigrosine dispersion and a 0.03 g portion of Compound (3) of the present invention obtained in Synthesis Example 1 were dispersed into 1 liter of Shellsol-71 to prepare a liquid developer for electrophotography.

The thus obtained liquid developer was employed as a developer in a Fuji full-automatic process machine ELP 280 (produced by Fuji Photo Film Co., Ltd.), and ELP master (produced by Fuji Photo Film Co., Ltd.) was used as an electrophotographic photoreceptive material for making a printing master. A positive image having continuous tone on an original was reproduced on the ELP master using the above-described process machine. The image reproduced on the thus made master plate was a continuous tone image of good quality, and had a maximum optical density of 1.48 and a minimum optical density (fog) of 0.06. The image had a warm tone. 2,000 sheets of ELP masters were processed in the same manner. The 2,000th master plate was examined for optical density of the reproduced image. The maximum optical density was 1.40, and only a small decrease was observed, compared with that of the 1st master plate, while no change was observed in the minimum density. Both the image reproduced on the 1st master plate and the image reproduced on the 2,000th master plate were very clear.

Nonimage areas of the 1st master plate and the 2,000th master plate were submitted to a desensitization processing respectively to convert the master plates into printing plates. 3,000 copies were printed using each of the thus made printing plates. The 3,000th copy was clearly printed, whether the plate used was derived from the 1st master plate or the 2,000th one. More specifically, no breaks in fine lines and no fog were observed in all of the prints obtained.

EXAMPLES 2 TO 16

Four kinds of liquid developers for electrostatic photography were prepared in the same manner as in Example 1 except that polymers as set forth in Table 1, respectively, were employed in place of the polymer corresponding to Compound (3) in the present invention (charge controlling agent).

For purposes of comparison, the other liquid developer was further prepared in the same manner as described above except that known charge controlling agent or the copolymer of diisobutylene and maleic acid semioctadecylamide was used in place of those presented by the present invention.

The thus-prepared developers were tested for their abilities using the same process as in Example 1. The maximum density of the image reproduced on the 1st master plate and the maximum density in the same image area of the 2,000th master plate were measured, and the rate of change in the maximum density was determined by the following equation.

$$\text{Change Rate (\%)} = 100 - \frac{\text{image density of 2,000th master plate}}{\text{image density of 1st master plate}} \times 100$$

Both the 1st and the 2,000th master plates were converted into printing plates in the same manner as in Example 1, and 3,000 copies were printed using each of the thus made printing plates. Results of observations on the images reproduced as prints are summarized in Table 1.

TABLE 1

| Example No. | Polymer (charge controlling agent) | Image Density of Master Plate: 1st | Image Density of Master Plate: 2,000th | Change Rate (%) | Printed Image: 1st Master Plate Was Used | Printed Image: 2,000th Master Plate Was Used |
|---|---|---|---|---|---|---|
| 2 (Invention) | Compound (2) | 1.41 | 1.29 | 8 | Clear | Clear |
| 3 (Invention) | Compound (4) | 1.45 | 1.28 | 12 | Clear | Clear |
| 4 (Invention) | Compound (6) | 1.40 | 1.28 | 9 | Clear | Clear |
| 5 (Invention) | Compound (8) | 1.40 | 1.33 | 5 | Clear | Clear |
| 6 (Invention) | Compound (17) | 1.49 | 1.37 | 8 | Clear | Clear |
| 7 (Invention) | Compound (18) | 1.51 | 1.48 | 2 | Clear | Clear |
| 8 (Invention) | Compound (22) | 1.45 | 1.28 | 12 | Clear | Clear |
| 9 (Invention) | Compound (25) | 1.49 | 1.36 | 9 | Clear | Clear |
| 10 (Invention) | Compound (26) | 1.46 | 1.39 | 5 | Clear | Clear |
| 11 (Invention) | Compound (39) | 1.51 | 1.48 | 2 | Clear | Clear |
| 12 (Invention) | Compound (40) | 1.45 | 1.42 | 2 | Clear | Clear |
| 13 (Invention) | Compound (41) | 1.46 | 1.39 | 5 | Clear | Clear |
| 14 (Invention) | Compound (42) | 1.42 | 1.36 | 4 | Clear | Clear |
| 15 (Invention) | Compound (43) | 1.45 | 1.42 | 2 | Clear | Clear |

TABLE 1-continued

| Example No. | Polymer (charge controlling agent) | Image Density of Master Plate 1st | 2,000th | Change Rate (%) | Printed Image 1st Master Plate Was Used | 2,000th Master Plate Was Used |
|---|---|---|---|---|---|---|
| 16 (Comparison) | Diisobutylene-Maleic Acid Semioctadecylamide Copolymer | 1.48 | 1.04 | 30 | Clear | Generation of Breaks in Fine Lines. Increase in Fog. |

As can be seen from the data of Table 1, all of the master plates obtained in each of Examples 2 to 15, wherein the polymers of the present invention were employed, achieved high maximum image density, and only a small decrease in the maximum image density was observed even after 2,000 sheets of master plates were processed. In Example 16 carried out for comparison, on the other hand, the 1st master plate achieved high maximum image density, but large decrease in image density was caused in the 2,000th master plate. The printing plate obtained using this 2,000th master plate provided copies in which a considerable number of breaks were present in fine lines, and fog was generated in non-image areas (the 2,000th master plate had the density of 0.10 in the nonimage areas, and this density value was higher than that of the 1st plate.)

EXAMPLES 17 TO 25

Liquid developers for electrostatic photography were prepared in the same manner as described in Example 1, except that polymers as set forth in Table 2, respectively, were employed in place of the polymer corresponding to Compound (3) in the present invention (charge controlling agent).

The thus obtained developers were tested for their abilities using the same process as in Example 1. The maximum density of the image reproduced on the 1st master plate and the maximum density in the same image area of the 2,000th master plate were measured, and the rate of change therein was determined. The results obtained are shown in Table 2.

TABLE 2

| Example No. | Polymer (charge controlling agent) | Image Density 1st Master Plate | 2,000th Master Plate | Change Rate (%) |
|---|---|---|---|---|
| 17 | Compound (5) | 1.39 | 1.31 | 6 |
| 18 | Compound (10) | 1.40 | 1.30 | 7 |
| 19 | Compound (11) | 1.41 | 1.28 | 9 |
| 20 | Compound (14) | 1.39 | 1.31 | 6 |
| 21 | Compound (23) | 1.46 | 1.36 | 7 |
| 22 | Compound (28) | 1.47 | 1.40 | 5 |
| 23 | Compound (33) | 1.49 | 1.40 | 6 |
| 24 | Compound (34) | 1.47 | 1.40 | 5 |
| 25 | Compound (35) | 1.45 | 1.33 | 8 |

As can be seen from the data of Table 2, all of the master plates obtained in each of Examples 17 to 25, wherein the polymers of the present invention were employed, achieved high maximum image density, and only a small decrease in maximum image density was observed even after 2,000 sheets of master plates were processed.

EXAMPLE 26

To a 100 g portion of the white resin dispersion obtained in Example 1 was added 5 g of finely divided Sumikalon Navy Blue powder (produced by Sumitomo Chemical Co., Ltd.). The resulting mixture was stirred at 100° C. for 5 hours. After cooling, the reaction mixture was passed through 200-mesh nylon cloth. Thus, a blue resinous dispersion was obtained. The dispersion had a mean particle size of 0.18 μm.

A liquid developer was prepared by dispersing a 35 g portion of the blue resinous dispersion described above and 0.035 g of the Compound (43) of the present invention into 1 liter of isodecane. The liquid developer was tested by using the method described in Example 1.

Both the 1st master plate and the 2,000th master plate provided continuous tone images of good quality, and the maximum optical densities of said images were 1.40 and 1.38, respectively. On the other hand, the minimum densities (fog) were both 0.06.

Both the 1st and the 2,000th master plates were processed in a conventional manner to make printing plates. 3,000 copies were printed using each of the thus made plates. Even after the printing operation repeated 3,000 times or more, clear prints were obtained.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography containing, in a nonaqueous solvent having an electrical resistance of $10^9$ Ω·cm or more and a dielectric constant of 3.5 or less, (i) a toner containing a resin as a main component and (ii) a copolymer comprising two repeating units represented by formula (Ia) or (Ib) and formula (II):

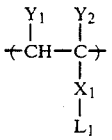

(Ia)

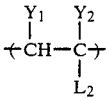

(Ib)

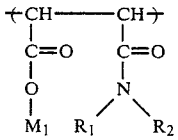

(II)

wherein $X_1$ is a group for connecting an atomic group $L_1$ to the main chain, and represents —O—, —$CH_2$OCO—, —OCO—, or —COO—; $L_1$ represents an aliphatic group, an alicyclic hydrocarbon group, an aryl group, or a heterocyclic group; $L_2$ represents an aliphatic group, an alicyclic hydrocarbon group, an aryl group, or a heterocyclic group each of which contains 6 or more carbon atoms; $Y_1$ and $Y_2$ each represents a hydrogen atom or an alkyl group; $R_1$ and $R_2$ each represents a hydrogen atom, an aliphatic group, an alicyclic hydrocarbon group, an aryl group, or a heterocyclic group, or $R_1$ and $R_2$ combine with each other to form a closed ring; and $M_1$ represents a hydrogen atom, a metal atom, or an ammonium salt or a quaternary salt of an organic base; or a copolymer comprising three repeating units represented by formula (IIIa) or (IIIb), formula (IV) and formula (V):

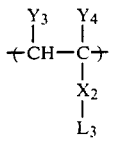
(IIIa)

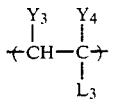
(IIIb)

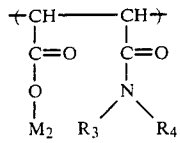
(IV)

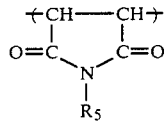
(V)

wherein $X_2$ is a group for connecting an atomic group $L_3$ to the main chain, and represents —O—, —$CH_2OCO$—, —OCO—, or —COO—; $L_3$ represents an aliphatic group, an alicyclic hydrocarbon group, an aryl group, or a heterocyclic group; $Y_3$ and $Y_4$ each represents a hydrogen atom or an alkyl group; $R_3$ and $R_4$ each represents a hydrogen atom, an alipahtic group, an alicyclic hydrocarbon group, an aryl group, or a heterocyclic group, or $R_3$ and $R_4$ combine with each other to form a closed ring; $M_2$ represents a hydrogen atom, a metal atom, or an ammonium salt or a quaternary salt of an organic base; and $R_5$ represents a hydrogen atom, an aliphatic group, an alicyclic hydrocarbon group, an aryl group, or a heterocyclic group.

2. A liquid developer for electrostatic photography as in claim 1, wherein the liquid developer containing, in a nonaqueous solvent having an electrical resistance of $10^9$ Ω·cm or more and a dielectric constant of 3.5 or less, (i) a toner containing a resin as a main component and (ii) a copolymer comprising two repeating units represented by formula (Ia) or (Ib) and formula

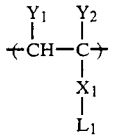
(Ia)

-continued

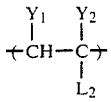
(Ib)

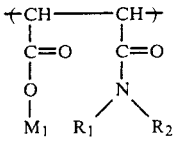
(II)

wherein $X_1$ is a group for connecting an atomic group $L_1$ to the main chain, and represents —O—, —$CH_2OCO$—, —OCO—, or —COO—; $L_1$ represents an aliphatic group, an alicyclic hydrocarbon group, an aryl group, or a heterocyclic group; $L_2$ represents an aliphatic group, an alicyclic hydrocarbon group, an aryl group, or a heterocyclic group each of which contains 6 or more carbon atoms; $Y_1$ and $Y_2$ each represents a hydrogen atom or an alkyl group; $R_1$ and $R_2$ each represents a hydrogen atom, an aliphatic group, an alicyclic hydrocarbon group, an aryl group, or a heterocyclic group, or $R_1$ and $R_2$ combine with each other to form a closed ring; and $M_1$ represents a hydrogen atom, a metal atom, or an ammonium salt or a quaternary salt of an organic base.

3. A liquid developer for electrostatic photography as in claim 1, wherein the liquid developer containing, in a nonaqueous solvent having an electrical resistance of $10^9$ Ω·cm or more and a dielectric constant of 3.5 or less, (i) a toner containing a resin as a main component and (ii) a copolymer comprising three repeating units represented by formula (IIIa) or (IIIb), formula (IV) and formula (V):

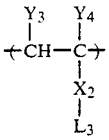
(IIIa)

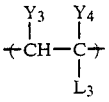
(IIIb)

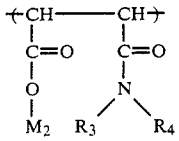
(IV)

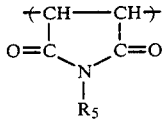
(V)

wherein $X_2$ is a group for connecting an atomic group $L_3$ to the main chain, and represents —O—, —$CH_2OCO$—, —OCO—, or —COO—; $L_3$ represents an aliphatic group, an alicyclic hydrocarbon group, an aryl group, or a heterocyclic group; $Y_3$ and $Y_4$ each represents a hydrogen atom or an alkyl group; $R_3$ and $R_4$ each represents a hydrogen atom, an aliphatic group, an alicyclic hydrocarbon group, an aryl group, or a heterocyclic group, or $R_3$ and $R_4$ combine with each other to form a closed ring; $M_2$ represents a hydrogen atom, a metal atom, or an ammonium salt or a quaternary salt of an organic base; and $R_5$ represents a hydrogen atom, an aliphatic group, an alicyclic hydrocarbon group, an aryl group, or a heterocyclic group.

4. A liquid developer for electrostatic photography as in claim 2, wherein $L_1$ represents an unsubstituted or substituted alkyl group having from 1 to 32 carbon atoms, an unsubstituted or substituted alkenyl group having from 4 to 32 carbon atoms, an unsubstituted or substituted aralkyl group having from 7 to 32 carbon atoms, an unsubstituted or substituted cycloalkyl group having from 5 to 32 carbon atoms, an unsubstituted or substituted aryl group having from 6 to 32 carbon atoms, or a not less than 5-membered unsubstituted or substituted heterocyclic group;

$L_2$ represents an unsubstituted or substituted alkyl group having from 6 to 30 carbon atoms, an unsubstituted or substituted aralkyl group having from 7 to 32 carbon atoms, a cycloalkane group having 6 or more carbon atoms, or an unsubstituted or substituted aryl group having from 6 to 32 carbon atoms;

$Y_1$ and $Y_2$ each represents a hydrogen atom or a methyl group;

$R_1$ and $R_2$ each represents a hydrogen atom, an unsubstituted or substituted alkyl group having from 1 to 28 carbon atoms, an unsubstituted or substituted aralkyl group having from 7 to 32 carbon atoms, an unsubstituted or substituted alkenyl group having from 2 to 32 carbon atoms, an unsubstituted or substituted alicyclic hydrocarbon group having from 5 to 32 carbon atoms, an unsubstituted or substituted aryl group having from 6 to 32 carbon atoms, or an unsubstituted or substituted heterocyclic group having not less than 5 atoms; and $M_1$ represents a hydrogen atom, a metal atom capable of forming a salt together with an organic carboxylic acid, or an ammonium salt or a quaternary salt of an organic base.

5. A liquid developer for electrostatic photography as in claim 3, wherein $L_3$ represents an unsubstituted or substituted alkyl group having from 1 to 32 carbon atoms, an unsubstituted or substituted alkenyl group having from 4 to 32 carbon atoms, an unsubstituted or substituted aralkyl group having from 7 to 32 carbon atoms, an unsubstituted or substituted cycloalkyl group having from 5 to 32 carbon atoms, an unsubstituted or substituted aryl group having from 6 to 32 carbon atoms, or a not less than 5-membered unsubstituted or substituted heterocyclic group;

$Y_3$ and $Y_4$ each represents a hydrogen atom or a methyl group;

$R_3$ and $R_4$ each represents a hydrogen atom, an unsubstituted or substituted alkyl group having from 1 to 28 carbon atoms, an unsubstituted or substituted aralkyl group having from 7 to 32 carbon atoms, an unsubstituted or substituted alkenyl group having from 2 to 32 carbon atoms, an unsubstituted or substituted alicyclic hydrocarbon group having from 5 to 32 carbon atoms, an unsubstituted or substituted aryl group having from 6 to 32 carbon atoms, or an unsubstituted or substituted heterocyclic group having not less than 5 atoms;

$M_2$ represents a hydrogen atom, a metal atom capable of forming a salt together with an organic carboxylic acid, or an ammonium salt or a quaternary salt of an organic base; and $R_5$ represents a hydrogen atom, an unsubstituted or substituted alkyl group having from 1 to 28 carbon atoms, an unsubstituted or substituted aralkyl group having from 7 to 32 carbon atoms, an unsubstituted or substituted alkenyl group having from 2 to 32 carbon atoms, an unsubstituted or substituted alicyclic hydrocarbon group having from 5 to 32 carbon atoms, an unsubstituted or substituted aryl group having from 6 to 32 carbon atoms, or an unsubstituted or substituted heterocyclic group having not less than 5 atoms.

6. A liquid developer for electrostatic photography as in claim 2, wherein the weight ratio of the monomer component of formula (Ia) or (Ib) to the monomer component of formula (II) in the copolymer ranges from 10/90 to 99.5/0.5, and the molecular weight of the copolymer is from about 1,000 to 500,000.

7. A liquid developer for electrostatic photography as in claim 6, wherein the weight ratio of the monomer component of formula (Ia) or (Ib) to the monomer component of formula (II) in the copolymer ranges from 30/70 to 70/30.

8. A liquid developer for electrostatic photography as in claim 6, wherein the molecular weight of the copolymer is from about 5,000 to 50,000.

9. A liquid developer for electrostatic photography as in claim 3, wherein the weight ratio of the monomer component of formula (IV) to the monomer component of formula (V) in the copolymer ranges from 10/90 to 90/10.

10. A liquid developer for electrostatic photography as in claim 9, wherein the weight ratio of the monomer component of formula (IV) to the monomer component of formula (V) in the copolymer ranges from 30/70 to 70/30.

11. A liquid developer for electrostatic photography as in claim 3, wherein the weight ratio of the monomer component of formula (IIIa) or (IIIb) to the monomer component of formula (IV) plus the monomer component of formula (V) in the copolymer ranges from 10/90 to 99.5/0.5.

12. A liquid developer for electrostatic photography as in claim 11, wherein the weight ratio of the monomer component of formula (IIIa) or (IIIb) to the monomer component of formula (IV) plus the monomer component of formula (V) in the copolymer ranges from 30/70 to 70/30.

13. A liquid developer for electrostatic photography as in claim 3, wherein the molecular weight of the copolymer is from about 1,000 to 500,000.

14. A liquid developer for electrostatic photography as in claim 13, wherein the molecular weight of the copolymer is from about 5,000 to 50,000.

* * * * *